US009888798B1

(12) United States Patent
Berjis

(10) Patent No.: US 9,888,798 B1
(45) Date of Patent: Feb. 13, 2018

(54) BEVERAGE CONTAINER HOLDER

(71) Applicant: Pejman Berjis, Santa Monica, CA (US)

(72) Inventor: Pejman Berjis, Santa Monica, CA (US)

(73) Assignee: Studio H2O Corp., Santa Monica, CA (US)

( * ) Notice: Subject to any disclaimer, the term of this patent is extended or adjusted under 35 U.S.C. 154(b) by 0 days.

(21) Appl. No.: 15/187,653

(22) Filed: Jun. 20, 2016

(51) Int. Cl.
*A47G 23/02* (2006.01)

(52) U.S. Cl.
CPC ..... *A47G 23/0216* (2013.01)

(58) Field of Classification Search
CPC ..... A47G 23/00; A47G 23/02; A47G 23/0216
USPC ..... 220/738, 737; 229/403
See application file for complete search history.

(56) References Cited

U.S. PATENT DOCUMENTS 1,808,763 A 6/1931 Burdett
2,028,566 A 1/1936 Seipel et al.
5,203,490 A 4/1993 Roe
5,205,473 A 4/1993 Coffin, Sr.
5,425,497 A 6/1995 Sorenson
5,445,315 A 8/1995 Shelby
6,032,826 A 3/2000 Libit
6,053,352 A 4/2000 Cai
6,273,333 B1 * 8/2001 Ward ..... A47G 23/0216 220/738
6,290,091 B1 9/2001 Bell
6,343,735 B1 2/2002 Cai
6,364,151 B1 4/2002 Gale
6,863,644 B1 3/2005 Cook
D543,844 S 6/2007 Cook
7,264,134 B2 9/2007 Tulp
7,858,015 B2 * 12/2010 Urquhart ..... B65D 81/3876 162/218
2003/0075549 A1 4/2003 O'Brien et al.

* cited by examiner

*Primary Examiner* — King M Chu
(74) *Attorney, Agent, or Firm* — Thomas I. Rozsa

(57) ABSTRACT

A beverage container holder with air gap insulation that can be formed from a single sheet of material, can be formed with one single die cutting stroke, and does not involve glue or any other materials to retain the sections together as the sections are automatically retained together and formed into a round retaining member by the simple action of rotating the central sections approximately 90 degrees.

4 Claims, 9 Drawing Sheets

BEVERAGE CONTAINER HOLDER

BACKGROUND OF THE INVENTION

1. Field of the Invention

The present invention relates to the field of beverage container holders which are used to retain a beverage container that has a hot or cold liquid therein in order to enable a person to hold the container and consume the liquid with comfort and without burning the person's hand.

2. Description of the Prior Art

The following 16 patents and published patent applications are relevant to the field of the present invention:

1. U.S. Pat. No. 1,808,763 issued to Oliver Harry Burdett on Jun. 9, 1931 for "Holder For Paper Cups And The Like" (hereafter the "Burdett Patent");
2. U.S. Pat. No. 2,028,566 issued to Harry C. Seipel et al. on Jan. 21, 1936 for "Cup Holder" (hereafter the "Seipel Patent");
3. U.S. Pat. No. 5,203,490 issued to Mark E. Roe on Apr. 20, 1993 for "Hot Cup With Heat-Insulating Hand-Grip" (hereafter the "Roe Patent");
4. U.S. Pat. No. 5,445,315 issued to Charles B. Shelby on Aug. 29, 1995 for "Insulated Beverage Receptacle Holder" (hereafter the "Shelby Patent");
5. U.S. Pat. No. 6,032,826 issued to Jeanne E. Libit et al. on Mar. 7, 2000 for "Cup Holder" (hereafter the "Libit Patent");
6. U.S. Pat. No. 6,053,352 issued to Liming Cai on Apr. 25, 2000 for "Sleeve Protector For Cups" (hereafter the "'352 Cai Patent");
7. U.S. Pat. No. 6,273,333 issued to Eric Ward on Aug. 14, 2001 for "Combination Coaster And Cup Holder" (hereafter the "Ward Patent");
8. U.S. Pat. No. 6,290,091 issued to Allen Ray Bell on Sep. 18, 2001 for "Hot Or Cold Beverage Container Holder" (hereafter the "Bell Patent");
9. U.S. Pat. No. 6,343,735 issued to Liming Cai on Feb. 5, 2002 for "Insulating Sleeve" (hereafter the "'735 Cai Patent");
10. U.S. Pat. No. 6,364,151 issued to Gregory W. Gale on Apr. 2, 2002 for "Cup Holder" (hereafter the "Gale Patent");
11. United States Published Patent Application No. 2003/0075549 to David O'Brien et al. on Apr. 24, 2003 for "Bottle Cooler" (hereafter the "O'Brien Published Patent Application");
12. U.S. Pat. No. 7,264,134 issued to David W. Tulp on Sep. 4, 2007 for "Combination Coaster And Sleeve Apparatus" (hereafter the "Tulp Patent");
13. U.S. Pat. No. 5,425,497 issued to Jay Sorenson on Jun. 20, 1995 for "Cup Holder" (hereafter the "Sorenson Patent");
14. U.S. Pat. No. 5,205,473 issued to David W. Coffin, Sr. on Apr. 27, 1993 for "Recyclable Corrugated Beverage Container and Holder" (hereafter the "Coffin Patent");
15. U.S. Pat. No. 6,863,644 issued to Matthew R. Cook on Mar. 8, 2005 for "Beverage Container Holder" (hereafter the "Cook Patent");
16. U.S. Design Pat. No. D543,844 issued to Matthew R. Cook on Jun. 5, 2007 for "Protective Sleeve" (hereafter the "Cook Design Patent");

The Burdett Patent is an encircling device with a pair of gripping members 13 and 14.

The Seipel Patent discloses a cup holder which encircles the cup and has a multiplicity of ribbed exterior members to provide a cushion between the cup and the hands of a person holding the cup holder.

The Roe Patent discloses a hot cup with a heat insulating hand grip. The device is formed by having a tongue member inserted into an opening to complete the encircling device. A portion of the tab member is already affixed to the cup and then it can be completely used to encircle the cup as illustrated in the figures. There also are multiplicity of air gaps to provide further insulation between the person gripping the holder and hot liquid in the cup.

The Shelby Patent discloses an insulated beverage receptacle holder which is a polygonal shape and can be collapsed flat and then opened and retained its position by a tab member. It also has a bottom so that the cup presumably cannot extend through the bottom and this portion encircles the lower portion of the cup.

The Libit Patent is a cup holder which can be formed to encircle the cup and is enclosed by closing mechanisms which do not require glue.

The '352 Cai Patent is a design patent which protects the shape of the holder. The cup holder has a ribbed exterior pattern to provide the insulation and there is also a variation shown in FIG. 9 with a multiplicity of openings or air chambers 56.

The Ward Patent discloses a combination coaster and cup holder. It is a device which can be formed into a circle which encircles the cup with extended flanges to enable the holes to be gripped between two fingers.

The Bell Patent discloses:

> "A substantially cylindrical beverage container holder manufactured from a sheet of recycled pressed paper pulp is provided. The sheet is die cut from a blank having large and small opposing substantially rectangular sides connected by a bottom portion. The large side has a center panel and two glue flaps attached to the center panel by vertical fold lines. The bottom portion is substantially circular to conform to the shape of a beverage can and has fold lines that allow the blank to be folded so that the two rectangular sides are brought together in facing relationship. The large side glue flaps are glued to the small side to form a flat holder having vertical edges. The holder is opened by gently squeezing along the vertical edges, thereby creating an open top end of receiving a beverage container."

The '735 Cai Patent discloses an insulating sleeve which contains wing portions. The device envelopes the exterior of the cup.

The Gale Patent discloses a cup holder with a multiplicity of spaced apart sections.

The O'Brien Published Patent Application is a bottle cooler. The innovation is to have a multiplicity of openings which provide an air gap to provide insulation when it envelopes a cup.

The Tulp Patent discloses a combination coaster and sleeve apparatus wherein a coaster can be formed into a sleeve into which a cup can be retained.

The Sorenson Patent is a cup holder wherein the sleeve is wrapped around the cup and then one section of the sleeve is mated with another section through score lines to provide an enclosing device which has a multiplicity of ribbed patterns to provide the insulation.

The Coffin Patent is a recyclable corrugated beverage container wherein it is wrapped around the cup and has a multiplicity of exterior corrugations which serves as the insulating mechanism.

The Cook Patent is a beverage container holder.

The Cook Design Patent protects a sleeve which wraps around the cup and has an arcuate upper member.

SUMMARY OF THE INVENTION

The present invention is a beverage container holder that is formed from a single sheet of material, is formed with one single die cutting stroke, and does not involve glue or any other materials to retain the sections together as the sections are automatically retained together and formed into a round retaining member by the simple action of engaging score sections and operationally causing the score sections to be removed from side sections by a pushing of the score sections to break the connection at the score lines to thereby cause the completed beverage container to be formed with one single operation.

It is an object of the present invention to have a beverage container holder which is created from one single sheet of material and cut so that it has two oppositely disposed mirror image sections. These sections have a first central section with a first wing section on one side and a mirror image opposite second central section and mirror image opposite second wing section so that this will form the basis for the beverage container holder.

It is a further object of the present invention to have the above mentioned two sections separated by a major score line which in turn are connected to bend lines which create a beverage holder with a chimney section that enables heat to be generated and removed from the location adjacent the beverage container and enable an individual to hold the beverage container with hot or cold liquid therein.

It is a further object of the present invention to have the chimneys or spaces that are formed in the beverage container holder during use to create air gaps between the surface of the present invention that is touched by beverage container holder's hand and the hot or cold liquid within the container.

It is a further object of the present invention to have the present invention beverage container holders die cut from a single sheet of material which can be stacked, stored, and transported easily.

It is an even further object of the present invention to have the beverage container holder function and fold together for use without the need for glue or other adhesive to retain the present invention beverage container holder together during use. The present invention folds together and as explained in more detail herein, has portions of the invention specifically designed for better gripping of the beverage container holder and improved gripping contact between the beverage container holder and the exterior wall of the beverage container.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
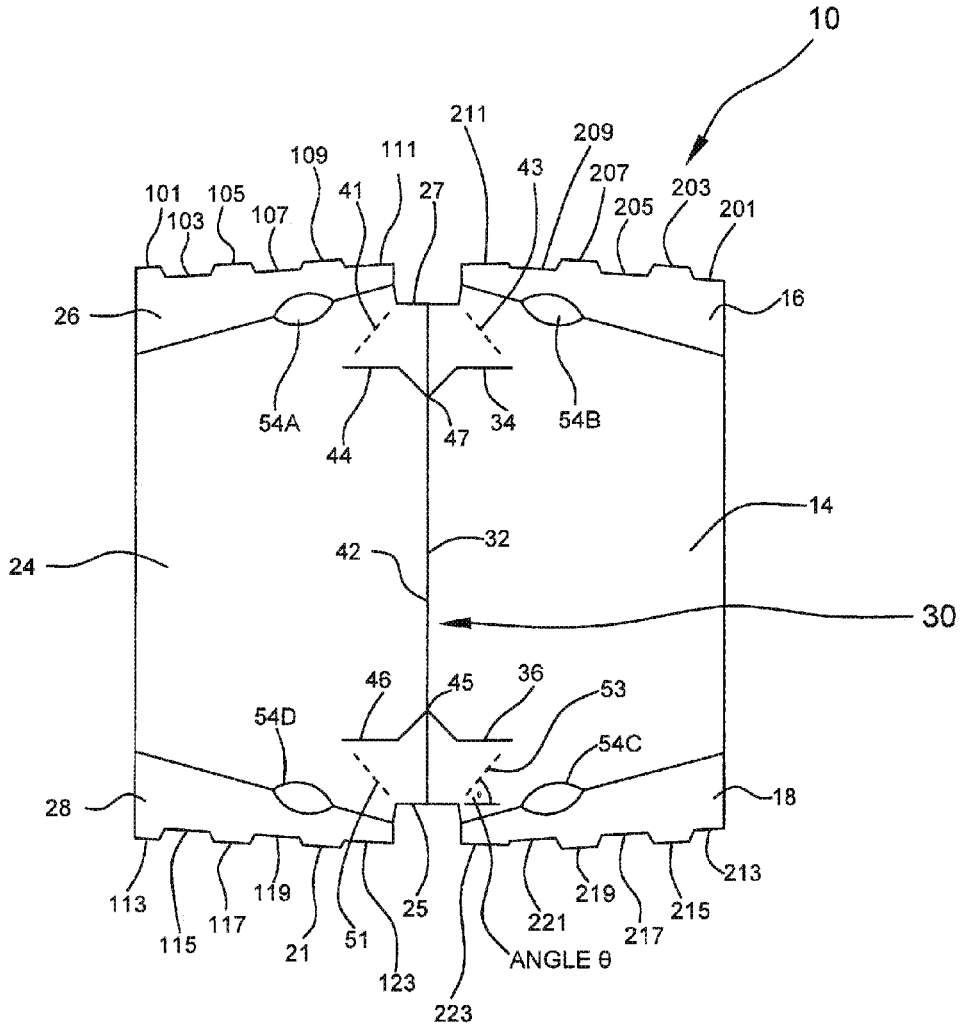
FIG. 1 is a top plan view of the preferred embodiment.

Referring to FIG. 1 there is illustrated a top plan view of the present invention beverage container holder 10 which is in the unopened condition. The beverage container holder 10 is cut from a single sheet of material which can be paperboard, cardboard, plastics, any synthetic material, metal, aluminum or any other firm material that can hold its shape once it is in the opened condition. The single sheet of paper is cut so that it has two oppositely disposed mirror image sections. These sections are labeled in FIG. 1 as first section 40 and second section 60. First section 40 has a first central section 14 with a first wing section 16 on one side and a second wing section 18 on the opposite side. The mirror image opposite second section 60 has a second central section 24, a third wing section 26 on one side and a fourth wing second 28 on the opposite side. Separating the first section 40 and second section 60 is a score section 30 having major score line 32 and major score line 42 which are mirror images of each other. Major score line 32 is connected at opposite ends to a first bend line 43 and a second bend line 53. Mirror image of major score line 32 is major score line 42 which is connected at opposite ends to bend line 41 and bend line 51. These score lines and bend lines are defined to include any crease or score or any other form to enable the sheet to be bent or folded along these lines.

Referring to FIG. 1, minor score lines 34 and 44 meet and form friction point 47 at the symmetrical center of the beverage container holder 10 when folded. Similarly, minor score lines 36 and 46 meet and form friction point 45 at the symmetrical center of the beverage container holder 10 when folded. Friction points 45 and 47 are formed when beverage container holder 10 is opened and in use, rotate at a downward angle creating a frictional griping force against a container being used with the current invention beverage container holder 10.

Further referring to FIG. 1, while the angle of the score lines as shown are at approximately a 45 degree angle from score lines 41 and 43 to respective top section 27 and score lines 51 and 53 are at approximately a 45 degree angle to top section 25, it will be appreciated that this is just one of the many angles that are within the spirit and scope of the present invention. The angle designated as theta "θ" in FIG. 1 can range anywhere from 10 degrees to 80 degrees, although 45 degrees is the preferred angle.

Figure 2:
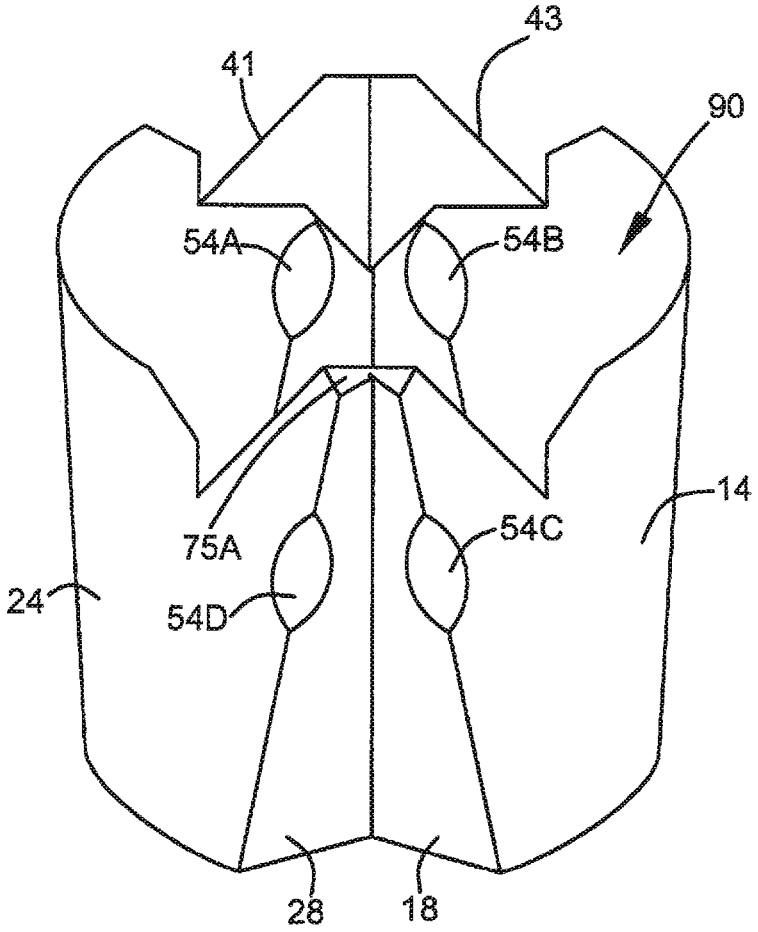
FIG. 2 is a front elevational perspective view of the beverage container holder.

The present invention in the open condition is shown in the perspective view in FIG. 2. To insert a container for use, central sections 14 and 24 are rotated approximately 90 degrees in opposite directions (one counter clockwise and one clockwise) about the axis where major score line 32 and major score line 42 meet or at the symmetrical center of beverage container holder 10. When rotated, interlocking sections found on wing sections 16, 18, 26, and 28 which are 101, 103, 105, 107, 109, 111, 113, 115, 117, 119, 121, 123, 201, 203, 205, 207, 209, 211, 213, 215, 217, 219, 221, and 223. Specifically, interlocking section 101 interlocks with section 201, interlocking section 103 interlocks with 203, interlocking section 105 interlocks with section 205, interlocking section 101 interlocks with section 201, interlocking section 107 interlocks with section 207, interlocking section 109 interlocks with section 209, interlocking section 111 interlocks with section 211, interlocking section 113 interlocks with section 213, interlocking section 115 interlocks with section 215, interlocking section 117 interlocks with section 217, interlocking section 119 interlocks with section 219, interlocking section 121 interlocks with section 221, and interlocking section 123 interlocks with section 223.

When wing section 18 and wing section 28 interlock, first air chimney 75A is created between top section 25, wing section 18, and wing section 28. Similarly, when first wing section 16 and third wing section 26 interlock, second air chimney 75B is created between top section 27, first wing section 16, and third wing section 26. These air chimneys are a key innovation of this invention and provide a level of insulation that has not been previously invented in the prior art of cardboard coffee cup sleeves.

Figure 6:
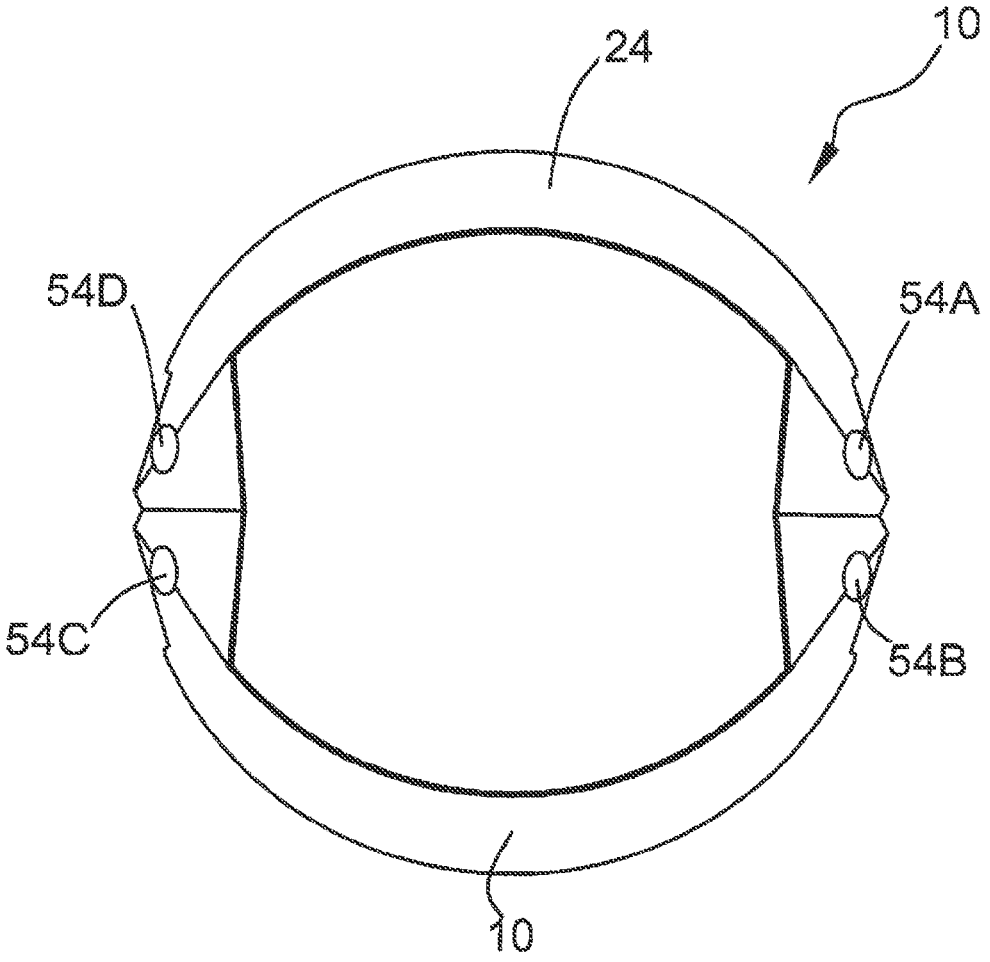
FIG. 6 is a bottom plan view of the beverage container holder without the beverage container.

Another unique feature of the present invention are the four (4) holes labeled 54A through 54D on beverage container holder 10. These holes provide a means to: allow air in to cool or heat the beverage, additional comfort when holding beverage container holder 10, and a means of stacking, storing, and dispensing beverage container holder 10, as shown in FIG. 6.

Figure 3:
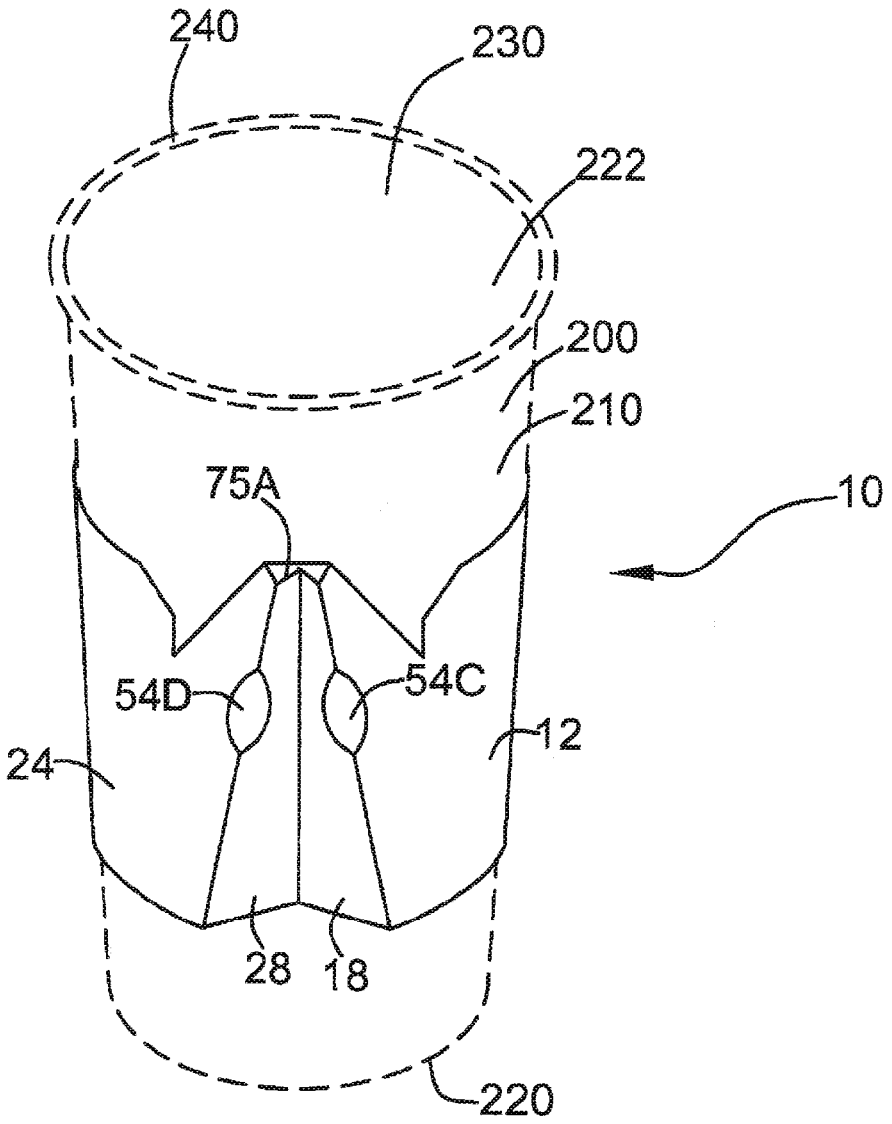
FIG. 3 is a front elevational perspective view showing the beverage container holder in use around a beverage container with the beverage container shown in dashed lines.
Figure 4:
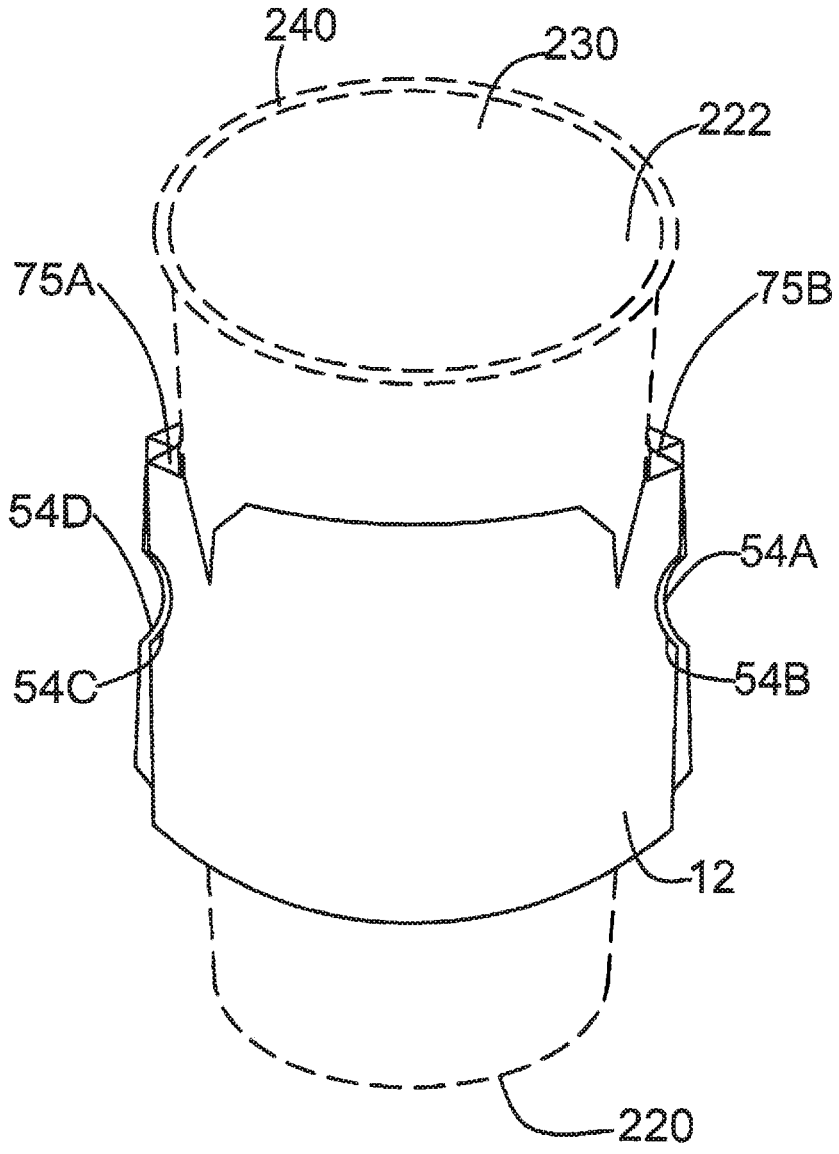
FIG. 4 is an elevational perspective view showing the beverage container holder in use around a beverage container with the beverage container shown in dashed lines rotated 90 degrees from the view in FIG. 3.

By having the design of the present invention which includes first wing section 16 and second wing section 18 on opposite sides of a first central section 14, and third wing section 26 and fourth wing section 28 on opposite sides of second central section 24, the two side sections separated by the score sections when folded cause the side sections to form a completed enclosure as best illustrated in FIG. 2. Wing sections 16, 26, 18, and 28 create two opposing areas for better gripping. This allows the beverage container holder 10 to be positioned on a cup to hold the cup at any desired grasp location. FIGS. 3 and 4 show the beverage container holder 10 in its open condition and in use around a beverage container.

Referring to FIG. 3, a beverage container 200 has a sidewall 210 with a bottom 220 and an opening 230 into which a hot or cold liquid such as coffee, tea, iced or frozen drinks, +or hot soup can be inserted and retained within the container 200 surrounded by the sidewalls 210 and 220. In operation, when the present invention beverage container holder 10 is formed into its operative condition as illustrated in FIG. 2, the cup or beverage container 200 can be inserted into the opening 90 preferably by having the bottom inserted over the beverage container holder 10 or having the beverage container holder 10 inserted under the cup by the opening extending over the opening 220 and around the sidewalls 210 of the beverage container 200.

Figure 5:
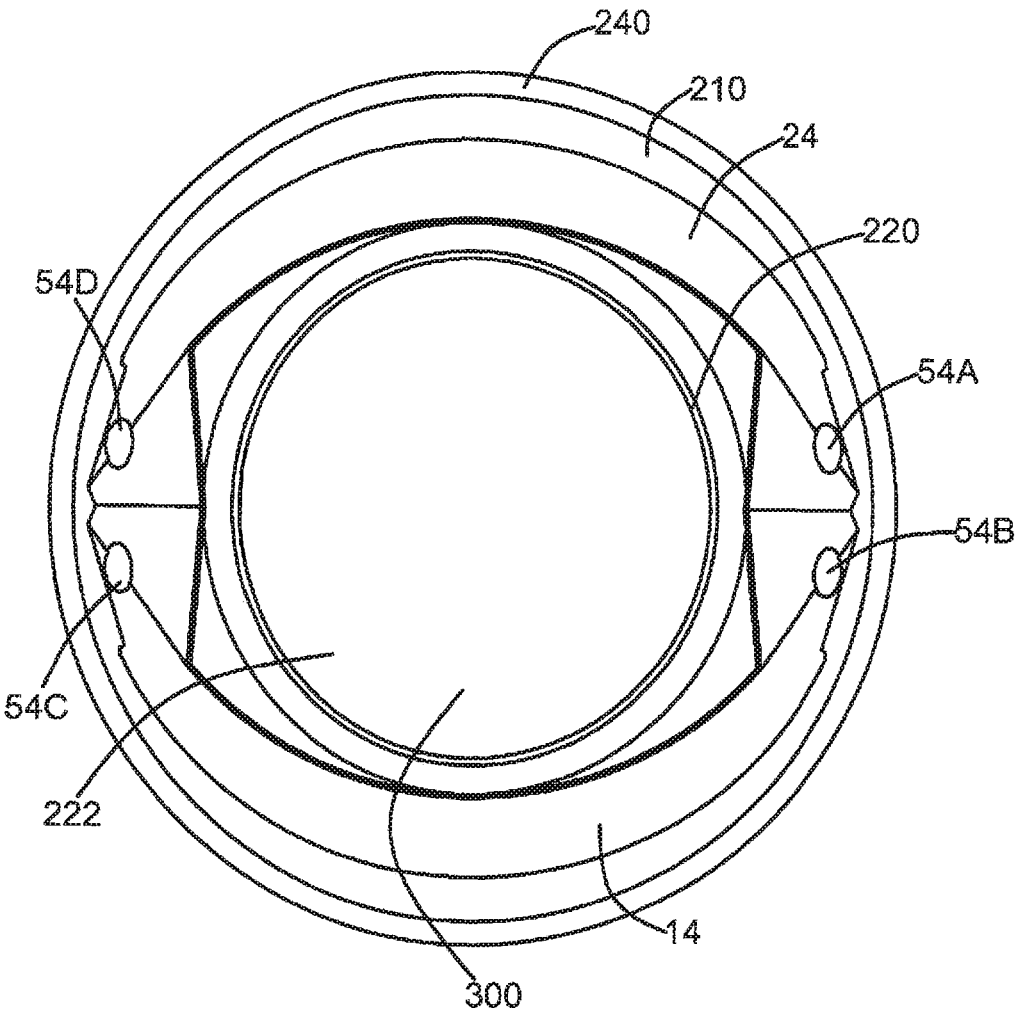
FIG. 5 is a bottom plan view of the beverage container holder in use around a beverage container illustrating the air gap with an extra set of dashed lines to more clearly define the air gap.

Referring to FIGS. 3 and 4, the design of beverage container holder 10 also provides a tactile source so the user can grasp the holder at the location of the wings without having to look at the cup retained by the holder after the holder has been oriented for the desired location on the cup. As a result, the quickness and ease of using beverage container holder 10 is substantially improved by the present invention. In addition, the novel feature of having the score sections with angular score cuts 51 and 41 for section 24 and 53 and 43 (shown on FIG. 1) enable the score sections to be folded inwardly when sections 14 and 24 are rotated in opposite directions as illustrated by the present invention beverage container holder 10 fitting around beverage container 200 in FIGS. 3, 4, and 5. This automatically causes beverage container holder 10 to be formed into its final shape with one simple operation of rotating section 14 in a clockwise and section 24 in a counter clockwise direction.

Some of the numerous benefits of the present invention are that the beverage container holder can be formed from a single sheet of material, can be formed with one single die cutting stroke, and does not involve glue or any other materials to retain the sections together as the sections are automatically retained together and formed into a round retaining member by the simple actions of engaging the score sections and rotating sections 14 and 24 about a central axis located at the symmetrical center of beverage container holder 10. This causes the completed beverage container holder to be formed with one single operation. Further benefits of the present invention include the utilization of the wings adjacent to the score sections. These wing sections when in use form air gaps as discussed above which substantially enhance the beneficial effects of the beverage container holder 10 by providing an air gap between the person's fingers holding the beverage container holder and the beverage container which contains hot liquid therein.

Referring to FIG. 6, a bottom view of the present invention beverage container holder 10 is illustrated. From this view without beverage container 200 shown, the four (4) holes labeled 54A through 54D on beverage container holder 10 are clearly illustrated.

Figure 7:
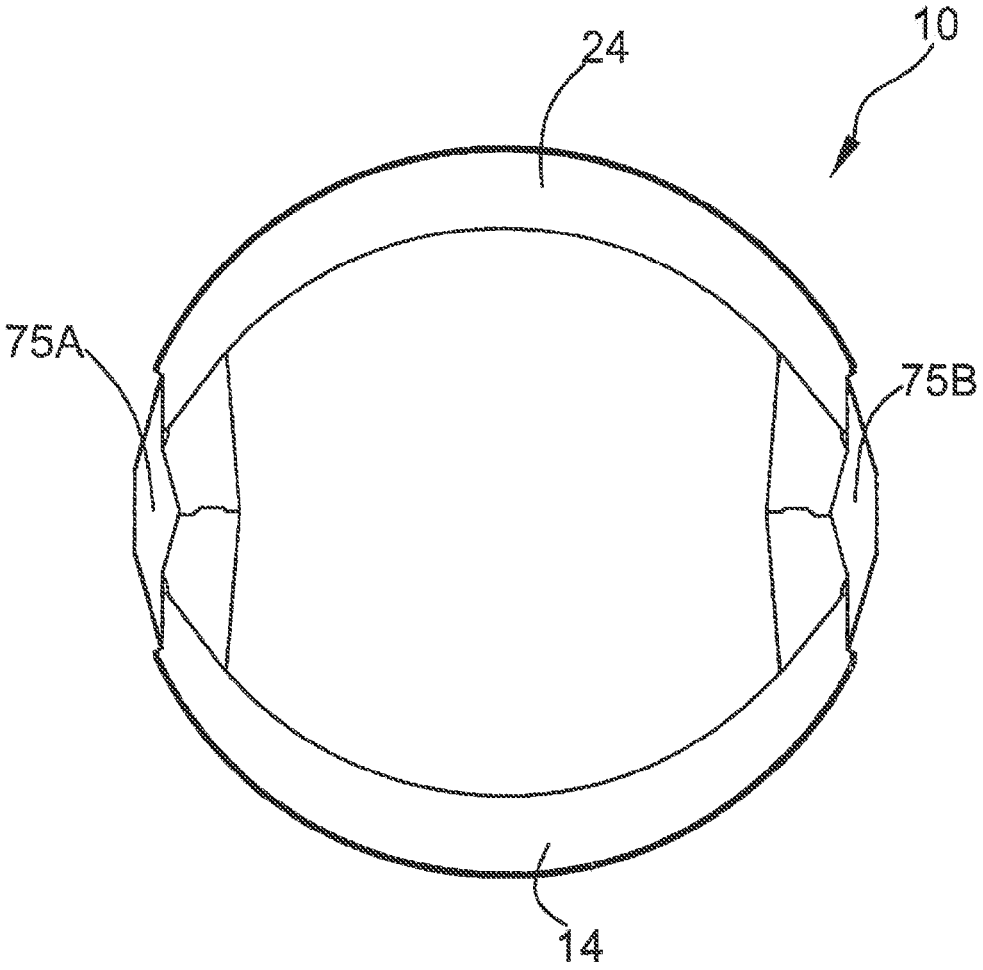
FIG. 7 is top plan view of the beverage container holder without the beverage container.

Referring to FIG. 7, the bottom view in FIG. 7, more clearly shows the bottom portions of air gaps 75A and 75B which are formed between the beverage container 200, central sections 14 and 24, and wing sections 18, 28, 16, and 26 (shown in FIG. 1). These air gaps provide further insulation between the beverage container holder 10 and the cup 200 containing a hot or cold liquid therein.

Figure 8:
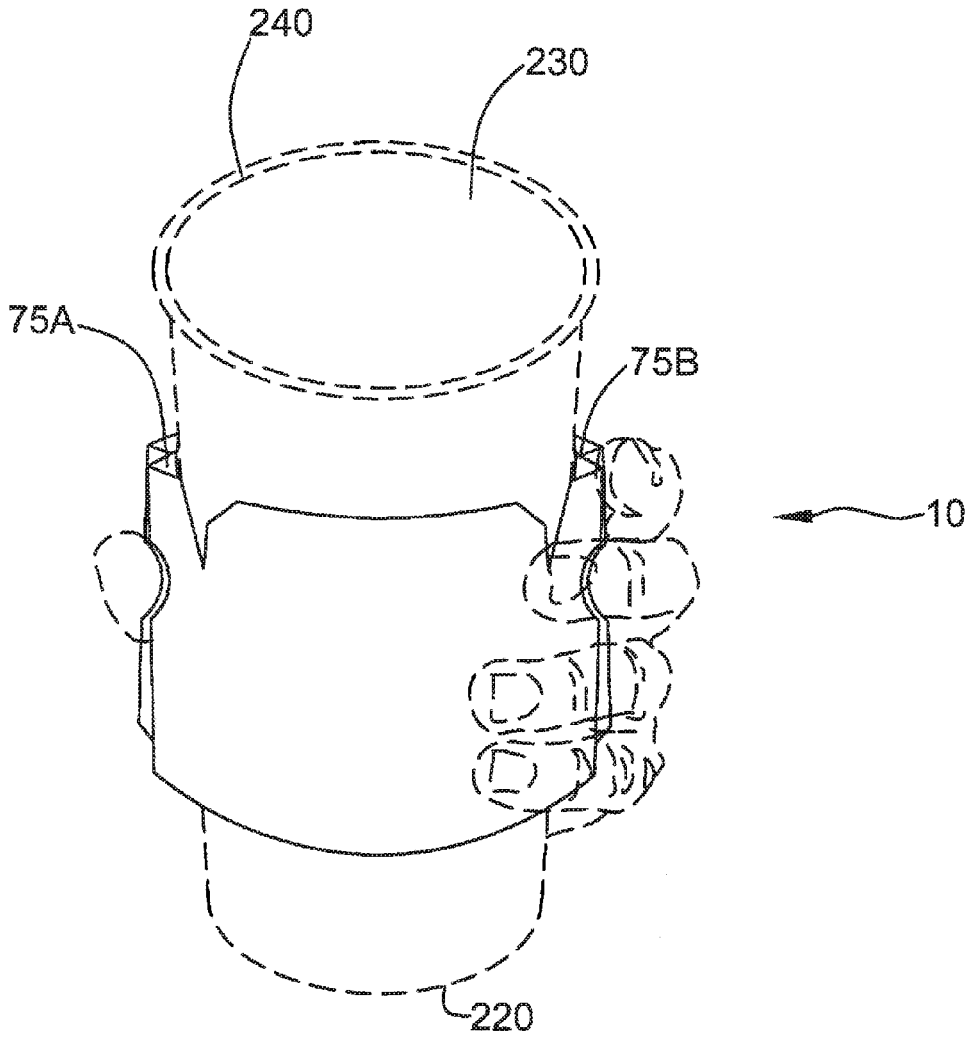
FIG. 8 is an elevational perspective view showing the beverage container holder in use around a beverage container and being held by a thumb and fingers.

Referring to FIG. 8, the elevational perspective view in FIG. 8 shows the beverage container bottom 220 and the beverage container lip 240 and beverage container sidewall 200 all shown in dashed lines with the present invention beverage container holder 10 being illustrated with sidewalls 14 and 24 engaging the sidewall 210 of cup 200.

Figure 9:
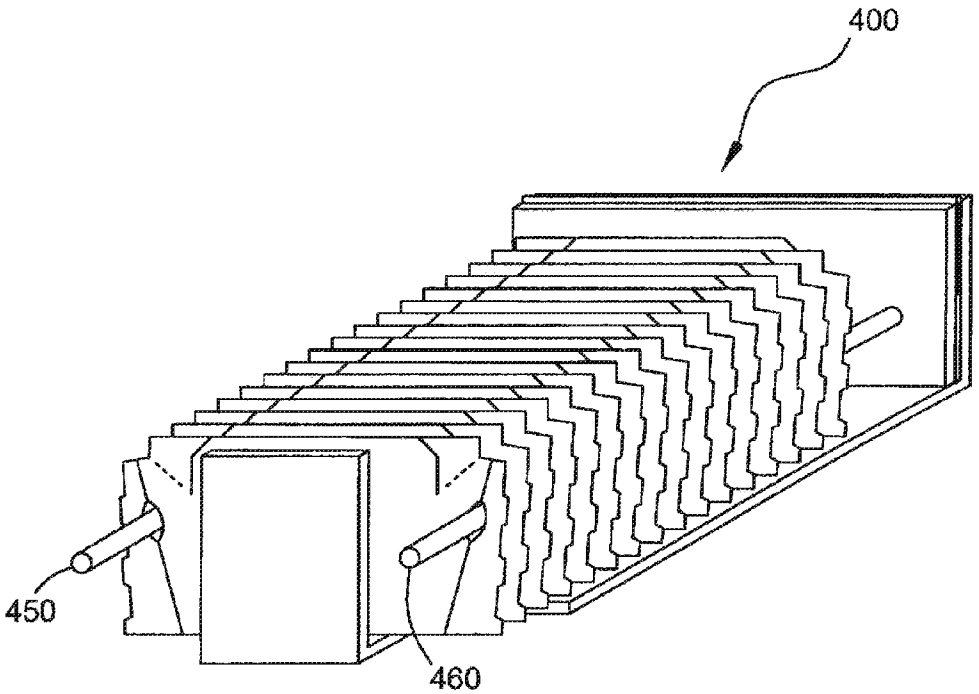
FIG. 9 is a perspectives view of a number of beverage container holders stored in a dispenser.

Another benefit of the present invention is that it can be formed from a single sheet of paper and cut with one die cut where all of the sections are formed and the die cut can also have a score section cut to form the two score members. In addition, because the beverage container holder can be formed in a single flat sheet as illustrated in FIG. 1, the sheets can be stacked adjacent each other in a dispenser so that they can be easily pulled out of the dispenser, as shown in FIG. 9, for immediate use by having holes 54A through 54D of beverage container holder 10 fit through dispenser rods 450 and 460 on dispenser 400.

Therefore, the present invention provides a simple, yet effective insulation device that can be formed by the unique design of wings and score sections which create insulation air gaps. This is an innovative concept in the field of beverage container holders.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A beverage container holder, comprising:

a. a single flat sheet formed into a pair of oppositely disposed mirror image sections and a pair of oppositely disposed score sections;

b. a first section of the pair of oppositely disposed mirror image sections having a first central section with a first wing section on one side and a second wing section of said pair of oppositely disposed mirror image sections on its opposite side, a second section having a second central section with a third wing section on one side and a fourth wing section on its opposite side;

c. a central score section separating the first central section and said second central section at a symmetrical center, the first central section having a score section having a body defined by a major score line that connects to a first bend line on one end and a second bend line on an opposite end, the second central section having a score section having a body defined by a major score line that connects to a first bend line on one end and a second bend line on the opposite end with both score lines and bend lines being mirror images of each other, d. said first wing section, said second wing section, said third wing section, and said fourth wing section each contain a multiplicity of interlocking members with interlocking members of said first wing section interlocking with interlocking members of said third wing section and interlocking members of said second wing section interlocking with interlocking members of said fourth wing section;

e. the first central section and the second central section forming a circumferential wall with a central chamber defined by oppositely disposed central sections and oppositely disposed score sections;

f. said central sections containing at least one circular hole; and g. a first air chimney formed from said first wing section, said third wing section, and a first top section and a second air chimney formed from said second wing section, said fourth wing section, and said second top section;

h. whereby said first central section and said second central section rotate in opposite directions about an axis where said first central section and said second central section meet and one of these directions of rotation being clockwise and the other direction of rotation being counterclockwise, wherein both central sections are rotated approximately 90 degrees enabling said first central section and said second central section to be facing in a vertical direction.

2. The beverage container holder in accordance with claim 1 wherein a multiplicity of unfolded flat sheet beverage container holders can be stacked adjacent to each other in a container.

3. The beverage container holder in accordance with claim 1 wherein the single sheet can be formed into the first and second sections and first and second score sections with one stamping operation.

4. The beverage container holder in accordance with claim 1 wherein the beverage container holder is made of material selected form the group consisting of paperboard, cardboard, card stock, plastic, synthetic plastic, metal, and aluminum.

* * * * *